United States Patent [19]

Roberts et al.

[11] Patent Number: 5,075,648

[45] Date of Patent: Dec. 24, 1991

[54] HYBRID MODE RF PHASE SHIFTER AND VARIABLE POWER DIVIDER USING THE SAME

[75] Inventors: Roger G. Roberts, Auburn; Jeff M. Alexander, Clarkston; James P. Montgomery, Roswell, all of Ga.

[73] Assignee: Electromagnetic Sciences, Inc., Norcross, Ga.

[21] Appl. No.: 330,617

[22] Filed: Mar. 30, 1989

[51] Int. Cl.[5] ..... H01P 5/04; H01P 5/107; H01P 5/12

[52] U.S. Cl. ..... 333/128; 333/24.1; 333/26

[58] Field of Search ..... 333/21 R, 24 C, 24.1, 333/26, 33, 157, 158, 128

[56] References Cited

U.S. PATENT DOCUMENTS

| | | | |
|---|---|---|---|
| 2,894,216 | 7/1959 | Crowe . | |
| 3,408,597 | 10/1968 | Heiter . | |
| 3,425,003 | 1/1969 | Mohr . | |
| 3,471,809 | 10/1969 | Parks et al. . | |
| 3,524,152 | 8/1970 | Agrios et al. . | |
| 3,539,950 | 11/1970 | Freibergs . | |
| 3,585,536 | 6/1971 | Braginski et al. . | |
| 3,599,121 | 8/1971 | Buck . | |
| 3,656,179 | 4/1972 | DeLoach . | |
| 3,758,886 | 9/1973 | Landry et al. . | |
| 3,838,363 | 9/1974 | Schilz | 333/24.1 |
| 3,849,746 | 11/1974 | Mason et al. . | |
| 3,952,267 | 4/1976 | Dischert . | |
| 3,986,149 | 10/1976 | Harris et al. . | |
| 4,001,733 | 1/1977 | Birch et al. . | |
| 4,349,790 | 9/1982 | Landry . | |
| 4,405,907 | 9/1983 | Breese et al. | 333/24.1 |
| 4,434,409 | 2/1984 | Green . | |
| 4,445,098 | 4/1984 | Sharon et al. . | |
| 4,679,249 | 7/1987 | Tanaka et al. | 333/26 X |
| 4,745,377 | 5/1988 | Stern et al. | 333/26 |
| 4,816,787 | 3/1989 | Stern et al. | 333/24.1 X |
| 4,881,052 | 11/1989 | Stern et al. | 333/24.1 |

*Primary Examiner*—Paul Gensler

*Attorney, Agent, or Firm*—Nixon & Vanderhye

[57] ABSTRACT

A miniaturized waveguide mode ferrite RF phase shifter is efficiently transitioned to a matched impedance microstrip transmission line mode at either end to result in an ultra small, efficient and lightweight essentially "planar" phase shifter device having wide application in the microwave industry.

37 Claims, 2 Drawing Sheets

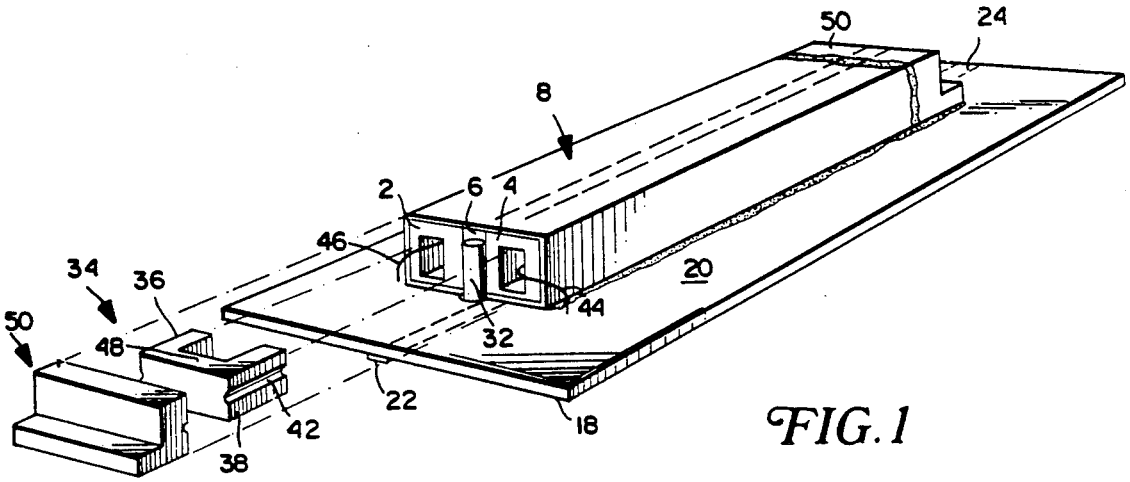
FIG. 1
FIG. 2
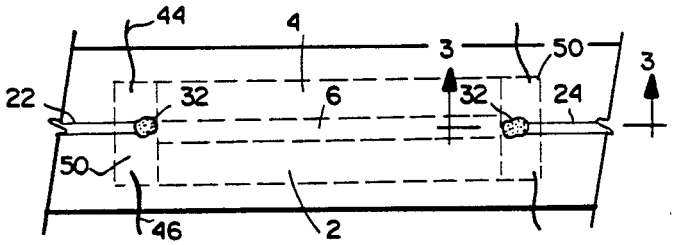
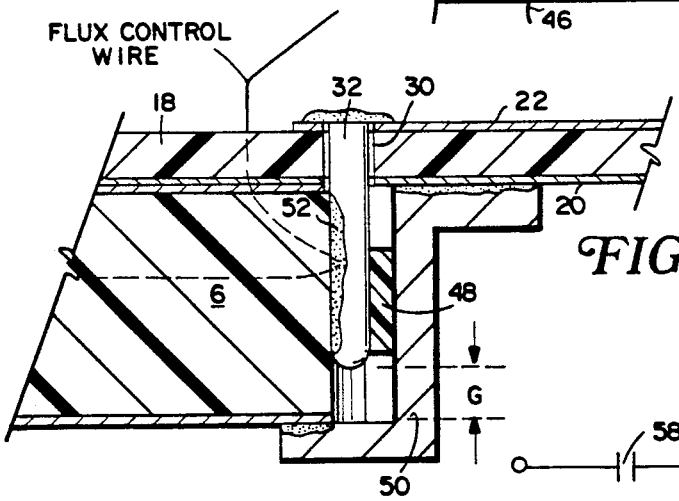
FIG. 3
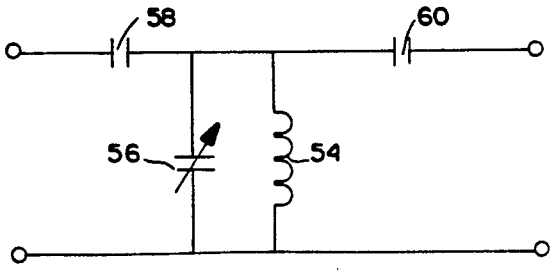
FIG. 4

HYBRID MODE RF PHASE SHIFTER AND VARIABLE POWER DIVIDER USING THE SAME

FIELD OF THE INVENTION

This invention relates generally to controllable RF phase shifters. It is particularly concerned with very high performance yet extremely small-sized phase shifters especially useful in phased RF radiator arrays at higher RF frequencies where available space between arrayed radiator elements is quite limited and essentially "planar" microstrip circuits are most effectively utilized. The invention has special utility for realizing small size phasors, switches, polarization networks and the like in the microwave industry.

RELATED APPLICATIONS

This application is related to the following copending commonly assigned patent applications (the content of which is hereby incorporated by reference):

Wallis, et al Ser. No. 07/333,961 filed Apr. 6, 1989; "Simplified Driver for Controlled Flux Ferrite Phase Shifter".

Roberts, Ser. No. 07/330,638 filed Mar. 30, 1989; "Reciprocal Hybrid Mode RF Circuit For Coupling RF Transceiver To An RF Radiator".

Rigg, Ser. No. 07/353,431 filed May 18, 1989; "Distributed Planar Array Beam Steering Control".

BACKGROUND OF THE INVENTION

Ideally, a controllable RF phase shifter should have minimum size, minimum insertion loss, minimum weight, minimum cost and complexity, substantial immunity from all adverse ambient environmental factors (including physical and electrical) and an ability to produce any desired phase shift accurately and instantly upon demand. Unfortunately, in spite of many years of effort by those in the art, the truly ideal phase shifter has yet to be realized.

One figure-of-merit commonly used for comparing phase shifter designs is the differential phase shift produced per decibel of insertion loss ($\Delta\phi$/dB). Previous ferrite phase shifters of the meanderline and slotline "planar" configuration (e.g. usable as part of a microstrip circuit) have had figure-of-merit factors on the order of 125 for operation in the X-band frequency range. Sometimes diode phase shifters are used in a form of planar substrate phase shifter (e.g. to switch in/out additional microstrip transmission line or to change the reactance across a transmission line). However, such diode phase shifters only have a figure-of-merit on the order of 180 at X-band.

A waveguide mode twin slab ferrite phase shifter (e.g. of the type described in commonly assigned U.S. Pat. No. 4,445,098 - Sharon et al) is one of the most accurate phase shifters known to date. However, in prior realizations, such waveguide mode phase shifters are large and expensive. If unswitched reciprocity is desired, this waveguide unit used in conjunction with circulators is too large for two dimensional phased arrays (where inter-radiator dimensions on the order of 0.6 wavelength are involved). A pair of hybrid mode devices of this invention, however, can be used to realize a non-switched reciprocal phase shifter which will fit the required small dimensions as described in the aforementioned related Roberts application.

At least two types of "planar" ferrite phase shifters have been used in the prior art. The meanderline and the slotline phase shifter are both low cost and lightweight planar ferrite phase shifters. However, high insertion loss and low power handling capability have made both of these devices impractical for general use. As mentioned earlier the figure-of-merit is on the order of only 125 for either the meanderline or the slotline phase shifter. The peak typical power handling capability of these devices (when having a figure-of-merit of 125) is on the order of 1OW to 20W (which is an order of magnitude less than the hybrid mode phase shifter of this invention).

The most common type of meanderline phase shifter has holes in the substrate for a latching wire which carries magnetizing current. For practical nonreciprocal phase shifters there exists a plane where the RF magnetic field is circularly polarized. The imposed phase shift inducing magnetization must be on the axis of the spinning RF magnetic field. The magnitude and direction of this magnetization causes a change in the permeability tensor and therefore a phase change. The meanderline phase shifter basically has a cross-section with a plane in the ferrite substrate where the coupled RF H-fields are orthogonal to each other. The meanderline section is a quarter wavelength long which means, on the axis of the meander, the H fields are orthogonal and one is delayed by 90° referenced to the other. Therefore a circularly polarized H field exists. For this reason the plane of circular polarization exists down the center of the meander section. As one deviates from the meander axis, the wave polarization becomes elliptical and linear at the edges. Therefore the active phase shifting area is only down the axis of the meander. For this reason, and also because of the required high RF currents due to the coupled structure, this device has a low figure-of-merit.

The slotline phase shifter gets its name from the wave structure itself. The slotline phase shifter is a transmission line consisting of a slot in a conductor on a ferrite substrate. The dominant mode in this type of transmission line is similar to a $TE_{10}$ mode in rectangular waveguide. The RF magnetic field has a plane of circular polarization in the ferrite substrate. This plane exists where the transverse H field is equal to the longitudinal H field. This phase shifter is not very efficient due to the RF field being distorted at portions extending away from the slot. The most active region is directly below the slot. The fields extending out of the transmission line also contribute to poor figure-of-merit thus making it less useful.

Some prior art patents presently considered relevant to this invention are listed below:

U.S. Pat. No. 3,539,950 - Freibergs (1970)
U.S. Pat. No. 3,585,536 - Braginski et al (1971)
U.S. Pat. No. 3,599,121 - Buck et al (1971)
U.S. Pat. No. 3,656,179 - DeLoach (1972)
U.S. Pat. No. 3,986,149 - Harris et al (1976)
U.S. Pat. No. 4,349,790 - Landry (1982)

Of those references, Freibergs appears to be possibly the most relevant to a "planar" microstrip phase shifter. However, he leaves the microstrip transmission line intact and simply surrounds it with suitable ferrites, magnetic fields, etc. The Freibergs device has a very low figure of merit (less than 100) and is therefore not very useful for most applications. The Braginski et al, Buck et al, DeLoach and Harris et al approaches to microstrip or stripline phase shifters also appear to leave the transmission line in an uninterrupted status through the phase shifting region (this appears to be true even for Harris et al which also refer to their phase shifter as being a "waveguide" phase shifter).

Landry teaches a waveguide phase shifter having a direct coaxial transmission line to waveguide transition. He notes that a traditional coax-to-waveguide E-plane transition for an unloaded waveguide involves a probe continuation of the coax center conductor extending into the waveguide perpendicular to one of its broad sides at one-fourth wavelength from a short circuit waveguide termination.

Landry then explains why that approach is impractical for phase-shifter waveguides loaded with ferrites and non-homogenous high dielectric structures and that therefore the prior art coax coupling to waveguide phase shifters typically has involved an extra waveguide transformer stage (referring to U.S. Pat. No. 3,758,886 - Landry et al).

Landry notes the lack of space efficiency involved in such prior art extra waveguide sections and then teaches a direct coax-to-waveguide phase shifter transition which includes an E-plane waveguide probe positioned significantly laterally off-center in the dielectric body in a slot extending into its lateral surface. As will be appreciated, effecting such a coupling in ultra-miniaturized waveguide phase shifters would be cumbersome at best.

In addition to Sharon et al, there are also many other examples of various kinds of waveguide ferrite phase shifters including various forms of dual toroid, nonreciprocal, latchable versons. As one simple nonexhaustive exemplary listing, the following are noted:

U.S. Pat. No. 2,894,216 - Crowe(1959)
U.S. Pat. No. 3,408,597 - Heiter(1968)
U.S. Pat. No. 3,425,003 - Mohr(1969)
U.S. Pat. No. 3,471,809 - Parks et al(1969)
U.S. Pat. No. 3,524,152 - Agrios et al(1970)
U.S. Pat. No. 3,849,746 - Mason et al(1974)
U.S. Pat. No. 3,952,267 - Dischert(1976)
U.S. Pat. No. 4,001,733 - Birch et al(1977)
U.S. Pat. No. 4,434,409 - Green(1984)

Some of these have added relevance for various specific details as well. For example, Mason et al teaches dielectric impedance transformers per se. while Dischert teaches metalized ferrite phase shifter structures (as does Birch et al).

BRIEF DESCRIPTION OF THE INVENTION

We have now discovered that the Sharon et al type of dual toroid ferrite phase shifter may be greatly miniaturized and incorporated serially with a microstrip transmission line to produce a novel, ultra-miniaturized, essentially planar, phase shifter of superior structure and performance.

Our invention may, in some respects, be described as a miniaturized waveguide phase shifter inserted serially between interrupted matched-impedance microstrip transmission line. Some embodiments may position the waveguide portion into the underlying ground plane structure while others dispose at least a portion of the waveguide above the top level of a microstrip substrate. In a presently preferred embodiment, the waveguide portion is butted between terminated ends of the microstrip substrate so that the maximum thickness of the whole device is merely that of the central waveguide portion.

A highly compact and efficient transition is made from an incoming microstrip transmission line to the miniaturized waveguide phase shifter and into a dielectric loaded waveguide volume. Coupling capacitance is provided to ensure proper matched-impedance transformations. Conventional steps may be taken to suppress spurious modes of RF propagation along the waveguide. A similar matched-impedance coupling is made at the other end of the miniaturized waveguide phase shifter structure back onto a microstrip transmission line.

The total thickness of the microstrip transmission line and waveguide structure may be on the order of 0.1 inch and while its width may be on the order of 0.3 inch and its length on the order of only 1.6 inch for operations in the X-band frequency range so as to make inter-element spacing at less than 0.6 wavelength at these frequencies absolutely no problem (e.g. at 10 GHz, 0.6 wavelength is about 0.7 inch). As the frequency increases, the inter-element spacing decreases. However, the size of the hybrid mode phase shifter also decreases proportionally. Therefore the inter-element spacing should present no problem over a wide range of microwave frequencies.

Our exemplary embodiment of this new phase shifter is a lightweight, low-cost planar substrate ferrite phase shifter which offers superior performance. Because it involves a transition from microstrip to (miniature) waveguide (and in the preferred embodiments back to microstrip RF transmission modes), it will be referred to as a "hybrid mode phase shifter". The experimental work was performed at X band and therefore X band frequencies are discussed herein. However, the hybrid mode phase shifter is capable of performing throughout the microwave frequency range (e.g. 1 GHz to 100 GHz).

Our new hybrid mode phase shifter has a figure-of-merit, differential phase per dB, of about 600 in the X-band frequency range. This is in comparison to about 125 for other known planar ferrite phase shifters such as the meanderline and slotline. Another planar substrate phase shifter (the diode phase shifter) has a figure-of-merit of approximately only 180 at X-band.

The phase errors associated with our new hybrid mode device are comparable to a conventional Sharon et al type of waveguide twin slab device, which is one of the highest accuracy phase shifters to date.

Although the new hybrid mode phase shifter is nonreciprocal, it can be switched between transmit and receive operations to obtain reciprocity, or due to the small size of this device, an unswitched reciprocal device can be achieved (using a pair of the nonreciprocal devices) and still fit in a phased array which requires very tightly spaced elements, e.g. 0.6 wavelengths.

When used in conjunction with a microstrip Wilkinson and branched line hybrid, the hybrid mode phase shifter makes it possible to achieve a low loss variable power divider (VPD) in a small scale essentially planar format. A significant reduction in size and weight of the hybrid mode VPD, in comparison to a comparable waveguide device, makes this hybrid mode VPD device extremely attractive for satellite multiple beam antennas.

The hybrid mode phase shifter is a planar substrate ferrite phase shifter which has a microstrip input and output. In one embodiment, a highly dielectrically loaded twin slab dual toroid phase shifter is metallized and soldered to the ground plane of a microstrip structure. On each end of the toroid is a low dielectric ($\epsilon'=2.3$) section which is cut off to the operating frequency and may be referred to as a waveguide cavity section. A groove or depression in an extended microstrip ground plane may house the toroids and cavity. Two holes in the substrate are made which line up with each end of the toroids. A pin is then inserted through the hole, soldered to the strip on the microstrip side and epoxied to the high dielectric ($\epsilon'=80$) center slab on the toroid side of the substrate.

One end of a miniaturized waveguide phase shifter is coupled (in an approximately impedance matched manner) serially within a microstrip transmission line so as to form a hybrid mode waveguide phase shifter. A preferred phase shifter that can be used is a miniaturized version of one described in U.S. Pat. No. 4,445,098 - Sharon et al. It includes elongated parallel ferri-magnetic toroids separated by a slab of high dielectric material sandwiched therebetween. A metallized waveguide surface is formed on the exposed sides of the composite toroid-slab-toroid structure and flux control wires pass axially through the toroid centers (all as described in Sharon et al).

In one exemplary embodiment, the miniaturized waveguide phase shifter is mounted in electrical contact with the ground plane of a microstrip transmission line (i.e. on the substrate side opposite the narrow microstrip line). Apertures extending through the ground plane (and substrate) are located at adjacent ends of the center dielectric slab. The microstrip line terminates at or near one aperture, and picks up again with another microstrip at or near the other aperture. A probe is mounted in electrical contact with each terminating end of microstrip and extends through its respective aperture into contact with the central waveguide dielectric. Dielectric wire guides are inserted in the ends of the toroids. Metal end caps (that make electrical contact with the metallized waveguide surface on the toroids and the metallized ground plane surface on the substrate) are mounted over the wire guides.

In another, presently preferred, exemplary embodiment of the invention, a microstrip transmission line is mounted at each end of the miniaturized waveguide phase shifter (with the microstrip dielectric substrate abutting the ends of both toroids and its metallized ground plane surfaces electrically joined to the metallized lower waveguide surface at the toroid bottoms—however, it has been noted that these surfaces do not have to be coplanar). The thickness of the microstrip substrate is less than the height of the waveguide toroids and the microstrip lines are terminated at the respective ends of the dielectric slab. A chip (or other) capacitance is in series between the microstrip line and the phase shifter via a conductive ribbon (so as to form a small generally triangular gap opening). The ribbon and capacitor and/or other capacitance realized in or near the small triangular space (i.e. between the ribbon and the center dielectric slab of the phase shifter) effect an efficient RF transition between the microstrip transmission line and waveguide RF modes.

In accordance with another aspect of this invention, a smaller, lighter-weight variable power divider (VPD) is provided by using a pair of the hybrid mode waveguide phase shifters. Because inputs and outputs are microstrip lines, they are easily integrally formed and connected to a Wilkinson divider at one end and to a branch line microstrip hybrid at the other end to result in a usable essentially "planar" variable power divider.

BRIEF DESCRIPTION OF THE DRAWINGS

These as well as other objects and advantages of this invention will be better appreciated by careful study of the following detailed description of exemplary embodiments taken in conjunction with the accompanying drawings, of which:

FIG. 1 is a perspective bottom view of a first exemplary embodiment of the invention in which matched serial coupling is achieved by probes attached directly to microstrip transmission line terminating and leading to the dielectric ends of a serially imposed waveguide phase shifter;

FIG. 2 is a top view of FIG. 1;

FIG. 3 is a cross-sectional depiction of one end of the device shown in FIGS. 1 and 2 illustrating the pin-type microstrip phase shifter coupling;

FIG. 4 is an approximate equivalent RF circuit of the microstrip and waveguide transmission media arrangement of FIG. 1;

DETAILED DESCRIPTION OF EXEMPLARY EMBODIMENTS OF THE INVENTION

Figure 5:
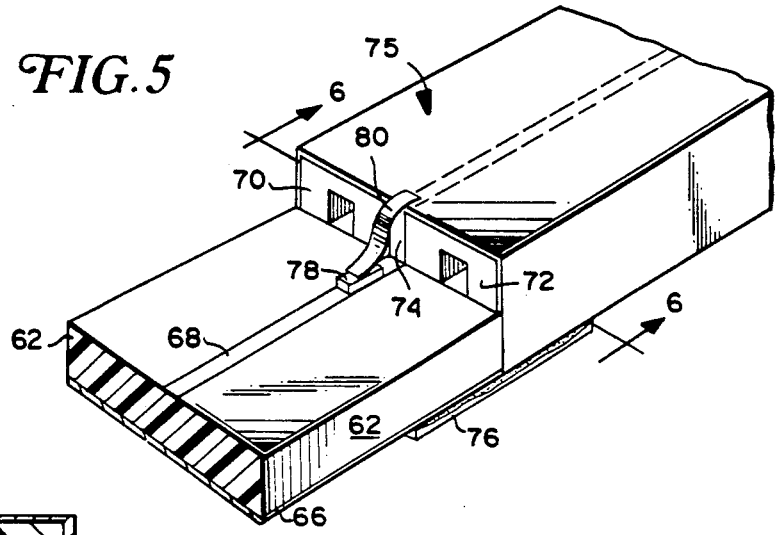
FIG. 5 is a perspective view of a presently preferred exemplary embodiment of this invention in which matched coupling between a waveguide phase shifter and abutting microstrip transmission line sections at either end is attained by a capacitance and metal ribbon.

In the perspective view of FIG. 1, parallel, elongated, rectangular ferrimagnetic toroids 2 and 4 have a slab 6 of high dielectric material affixed between their adjacent sides and metallized surfaces 8 on the outer sides of the composite toroid/slab/toroid structure to form a miniature waveguide internally thereof. A dielectric substrate 18, which also may be made of a ferrimagnetic material, has a metallized ground plane surface 20 on the side shown in FIG. 1 as soldered to the metallized surfaces 8. Conductive microstrip lines 22 and 24 on the opposide side of substrate 18 are shown in dashed lines. They extend to or a little bit beyond the ends of the toroids 2, 4 so to permit connection to a mode transition pin or probe 32 located at each end of the dielectric slab 6.

Although only one end of toroids 2 and 4 is visible in FIG. 1, the other end is the same. An aperture 30 in the metallized ground plane surface 20 extends, as better seen in FIG. 3, through the substrate 18 at a location adjacent the end of the dielectric slab 6. A metal probe 32, as better shown in FIG. 3, is mounted on and electrically connected to the microstrip line 22. It extends through the aperture 30 without touching the metallized surface 20. A U-shaped wire guide 34 is made of dielectric material and shaped with arms 36, 38 that can be respectively inserted into the center space of toroids 2, 4. Grooves 42 on the outer sides of the arms 36, 38 provide an ingress/egress passage for latching current wires 44, 46. When the wire guide 34 is mounted in position, its base or bight 48 bears against the probe 32 as shown in FIG. 3.

A metal end cap 50 is designed to fit around the wire guide 34 and is soldered to the metallized surface 20 as well as to the metallized surfaces 8 along the tops and outer sides of toroids 2, 4 to complete ends for the waveguide mode structure. An end cap 50 at the other end of the toroids is mounted as just described. The resulting cavity housing assists in tuning the probe transition to a matched impedance condition.

In the top view of FIG. 2, the microstrip lines 22 and 24 are seen, in reality, to provide a microstrip transmission line serially interrupted by the connection of the waveguide phase shifter via mode transmission probes 32. The bottoms of the probes, solder connections 32' are just in FIG. 2. As will be appreciated, miniature coaxial transmission line connectors can easily be connected to a short length of the microstrip 22 or 24 (thus providing a highly compact coax-microstrip-waveguide-microstrip-coax RF mode sequence). Clearly there are many possible alternate combinations and permutations if one omits some of the modes from one or both ends. Thus an overall coax-to-microstrip or microstrip-to-coax mode phase shifter device could be realized.

FIG. 3 shows the structure at the end of the toroids 2, 4 more clearly. The metal end cap 50 is soldered to the metallized surfaces 8 and to the metallized ground plane surface 20. Base 48 of the U-shaped wire guide is seen in section. The bottom of probe 32 is soldered to microstrip line 22, and epoxy 52 is deposited along the line of contact between probe 32 and the end of slab 6.

FIG. 4 is an approximate equivalent circuit for the matched coupling between microstrip mode lines 22, 24 and the waveguide mode phase shifter (i.e. the toroids 2, 4, slab 6 and the metallized surfaces 8). The beyond cutoff waveguide cavity is represented by shunt inductance 54, and the capacitance coupling provided by gap G between the distal end of a probe 32 and the opposite end cap 50 is represented by shunt capacitance 56. Capacitances 58 and 60 represent series capacitances associated with the probe.

Thus, the dual toroid design, as shown in FIGS. 1–4 includes two toroids 2, 4 separated by a slab of high dielectric material 6 ($\epsilon'=80$). The high dielectric slab 6 serves the same purpose as a dielectric center core in a single toroid design and, additionally provides a thermal path to remove heat from the toroid generated by RF power dissipation. The toroids and center core are secured together (e.g. epoxy) and metallized. The RF fields are thus concentrated in the center of the waveguide.

Therefore the most RF-active ferrite is located on each side of the dielectric slab. The outer portion of the toroids are relatively inactive and serve merely to complete a magnetic path and allow latching operations (as explained more fully in Sharon et al). The outer portions of the toroid do, however, decrease the efficiency (differential phase per unit length), because the dielectric material (the ferrite) at the waveguide walls is magnetized in a direction to subtract from the primary differential phase shift obtained by the inner walls. This effect is minimized by using a high dielectric center slab.

A unique transition impedance matching scheme is used in FIGS. 1–4 to match the dual toroid waveguide phase shifter section to the RF input and output microstrip transmission line structures. This matching technique may possibly be explained by considering the boundary between the toroid loaded waveguide structure and waveguide (operated beyond cutoff) cavity section. The boundary at the toroid and cavity section looks like a shunt inductance. The probe 32 protruding from the microstrip line appears as a shunt capacitance and a small series capacitance (as shown in the equivalent circuit of FIG. 4). The distance from the back plane of the cavity to the probe (i.e. space occupied by section 48 of the U-shaped dielectric member 34) and the probe gap distance G to the opposite side of the waveguide changes the shunt capacitance. Variable match-tuning capacitance, once the probe depth is fixed, is achieved from back plane adjustment of end caps 50. This technique permits broad frequency operation because the matching occurs, for all practical purposes, in the same plane as the impedance discontinuity.

The exemplary hybrid mode phase shifter of FIGS. 1–4 was assembled with OSM style connectors to microstrip adapters attached to the input and output for measurements. The return loss, insertion loss and phase was measured at X-band.

The return loss was measured over the frequency band of 9.575 to 10.46 GHz. The return loss was a minimum of approximately 15 dB over the frequency band. The return loss was limited due to the OSM to microstrip adapters at each end. From measurements made on a straight section of microstrip 50 ohm line with the OSM to microstrip connectors, it has been calculated that the hybrid mode phase shifter has a return loss greater than 23 dB over the same frequency band.

Insertion loss was measured over the same frequency range as the return loss, 9.575 to 10.4 GHz. The insertion loss was less than 1 dB across 80% of the frequency band. An insertion loss glitch in the center of the frequency band was observed due to a higher order mode resonance. This higher order mode is the $LSE_{11}$ mode and can be suppressed by reducing the height of the waveguide structure or by adding a conventional mode suppressor in the center slab between the dual toroids. The $LSE_{11}$ mode has been suppressed on subsequent designs by reducing the height of the phase shifter.

The phase shifter of FIGS. 1–4 was integrated with a flux driver and the maximum differential phase shift was measured to be 450°. Sixty-four phase states were optimized over the range from 0°to 360°. This gave phase increments of 5.625° (6-bit control). Phase was measured at 9.65 GHz as the command was varied from 0 to 63. The phase error as function of command had a peak phase error of 0.643°.

The most common use of the hybrid mode phase shifter may be for a phase shifter element in a phased array. Most phased arrays are used for both transmit and receive, therefore reciprocal operation, in most cases, is desired. The hybrid mode phase shifter is a nonreciprocal phase shifter. However it can be switched between transmit and receive for reciprocal operation. The hybrid mode phase shifter can•also be used in conjunction with microstrip circulators for nonswitched reciprocal operation (see related Roberts application noted above).

Using the novel hybrid mode phase shifter of this invention, it is possible to achieve low loss nonreciprocal phase shifters small enough to fit into a package which would allow 0.6 wavelength (0.7 inch at 10 GHz) element spacing at X-band. For example, the hybrid mode phase shifter may be constructed to have a cross section of 0.411 inch×0.60 inch, therefore 0.6 wavelength spacing does not present a problem.

Figure 6:
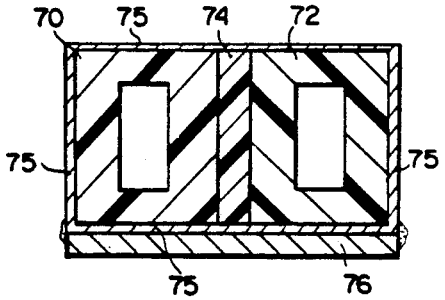
FIG. 6 is an end view of the invention shown in FIG. 5.
Figure 7:
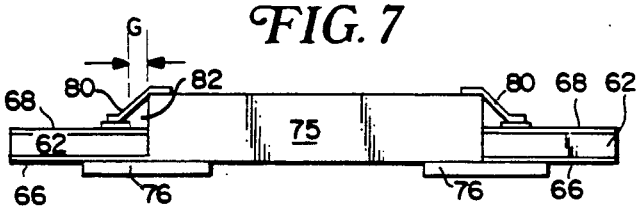
FIG. 7 is a side view of the invention shown in FIG. 5.

A presently preferred embodiment of the invention is illustrated in FIGS. 5–7. A microstrip line 68 (e.g. about 0.030 inch wide and 0.0002 inch thick) is butted against toroid ends 70 and 72. The exposed sides of the toroids 70 and 72 as well as the top and bottom of the high dielectric center slab 74 are metallized as indicated at 75 to form a miniaturized rectangular waveguide.

The metallized lower ground plane surface 66 of the microstrip structure makes electrical contact with the lower metallized surface 75. Mechanical rigidity as well as good electrical contact is provided by soldering a metal plate 76 (or plated dielectric substrate) to the metal ground plane surface 66 (at one end) and to an abutting lower end portion of the metallized surface 75.

The height of the microstrip dielectric 62 (e.g. about 0.055 inch) is less than the height of toroids 70 and 72 (e.g. about 0.100 inch) so that the microstrip 68 butts against slab 74 at a point near its vertical center. One side of a capacitance 78 (e.g. a chip capacitor) is mounted in electrical contact with the microstrip line 68, and a metal ribbon 80 (e.g. gold bonding ribbon 0.025 inch wide and 0.001 inch thick) is suspended in electrical contact (e.g. by soldering) between the other side of the capacitance 78 and a location on the top metallized surface 75 that is immediately above slab 74. In the alternative, the ribbon 80 can be conductively attached to the microstrip line 68 and capacitively coupled to the metallized surface 75 adjacent to the slab 74. As better seen in the side view of FIG. 7, ribbon 80 may form a roughly triangular opening 82. An identical mode transition structure at the other end of the toroids is generally shown in FIG. 7.

The gap dimension G between the ribbon 80 and the dielectric slab 74 is a tuning mechanism to impedance match between the microstrip transmission line and the phase shifter. Exact values for a given design are best obtained by routine experimentation. G is not a critical parameter, for instance, when the dielectric substrate is positioned co-planar with the top of the phase shifter, G becomes zero.

At a frequency of about 6 to 11 GHz, good operating results have been attained with the chip capacitor 78 (e.g. simply a suitable length of ribbon 80 insulated from microstrip line 68 by dielectric tape which results in a capacitance of about 0.3 pf), a mean gap distance G between the ribbon and the end of the slab 74 of about 0.015 to 0.40 inch and a height of the slab 74 above the microstrip 68 of about 0.050 inch.

In the FIGS. 5–7 technique for achieving the microstrip to ferrite toroid transition, as earlier stated, one key element of the matching technique is the realization of a series capacitive element in the microstrip line to toroid connection.

The transition shown in FIGS. 5–7 is capable of achieving a low insertion loss and a good impedance match. The assumed principle of operation can be explained in terms of an equivalent one stage LC ladder circuit. Here a shunt ladder inductance represents the shunt inductance of the basic microstrip to toroid junction. The capacitance is chosen to represent the required impedance for impedance matching between the microstrip and toroid waveguide characteristic impedances.

An X band unit was assembled and measured using this impedance matching technique. The return loss of the hybrid mode phase shifter in a microstrip test fixture has been measured using the described matching technique. A good impedance match is achieved for this specific case over a 15% bandwidth. The insertion loss of the same test fixture including the phase shifter is observed to be 1.3 dB over the same 15% bandwidth. The test fixture was calibrated out of the measurement and the insertion loss of the hybrid mode phase shifter was observed to be 0.7 dB which illustrates an excellent figure-of-merit (degrees phase shift/loss in dB) of 643°/dB.

Alternate matching techniques are also available which are similar to the present matching technique. For example:

1. The shunt inductance inherent in the microstrip to toroid junction may be adjusted by adding a shunt capacitance for an improved match. Many ways of achieving this shunt capacitance are available including those techniques commonly used for achieving capacitance in integrated circuits.
2. Multiple ladder matching sections or quarter wavelength microstrip sections may be used for wider bandwidth matching.
3. The microstrip and toroid phase shifter may include configurations where the ground planes are not necessarily coplanar. For example, the microstrip line may even be coplanar with the top of the phase shifter.

Whereas the invention has been described in connection with a dual toroid phase shifter, other waveguide phase shifters could be used. If a single toroid phase shifter is used, the probes of the first embodiment and the ribbon/capacitance/microstrip of the second embodiment preferably would be centered at its ends.

Figure 8:
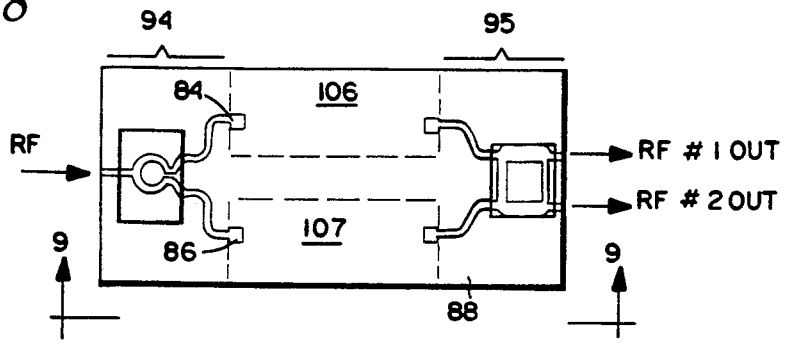
FIG. 8 is a top view of an exemplary "planar" circuit variable power divider in accordance with this invention.
Figure 9:
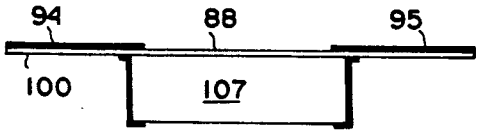
FIG. 9 is a side view of FIG. 8.

FIGS. 8 and 9 illustrate a variable power divider (VPD) having a known architecture, per se, in which two phase shifters 106, 107 are coupled between a Wilkinson microstrip divider 94 and a branch line 90° microstrip hybrid 95. However, when hybrid mode phase shifters of this invention are employed, a smaller VPD results with increased array utility believed novel as compared to VPD structures heretofor.

If the phase shifter embodiment of FIG. 1 is used, the dual toroid structures may be suspended from the ground plane side 100 of substrate 88 so that their microstrip input/output lines are ready for integral formation and connection to the microstrip Wilkinson divider 94 and branch line 90° microstrip hybrid 95.

In the elevation view of FIG. 9, the edges of microstrip conductor forming the Wilkinson divider 94, its output microstrip and the microstrip inputs 84, 86 to the phase shifters 106 and 107 can be seen as can the outputs for the phase shifters and the branch line hybrid. The dual toroid structure phase shifters 106, 107 are shown below the substrate 88.

Thus, as shown in FIGS. 8–9, a variable power divider (VPD) or, alternatively a variable power combiner (VPC), can be constructed by combining two 90° hybrid mode phase shifters with a 3 dB Wilkinson microstrip hybrid and a 3 dB 90° microstrip hybrid. With no amplitude imbalance in the VPD, the amplitude at the first output port will be given by the following equation:

$$\cos[(\phi_1-\phi_2)/2+45°] \qquad \text{[Equation 1]}$$

The amplitude at port 2 is therefore:

$$\sin[(\phi_1-\phi_2)/2+45°] \qquad \text{[Equation 2]}$$

A VPD is very useful for multiple beam antennas, for satellite applications or for any other application where it is desired to vary the RF amplitude provided to two RF utilization elements. For satellite applications, size, weight, insertion loss, and reliability are very important and the hybrid mode VPD of this invention excels in all of these areas.

With the 90° hybrid mode phase shifter, a VPD at X-band is projected to have dimensions of 1.2 inch×0.5 inch×0.2 inch and will weigh approximately 15 gms. This compares to a conventional waveguide unit which has the dimensions of 6 inch×2 ½ inch×1.5 inch weighing 150 gms.

The only advantage the conventional waveguide unit would have over the new hybrid mode unit would be a slightly lower insertion loss and higher power handling characteristic. The insertion loss of the conventional waveguide unit would be about 0.3 dB in comparison to about 0.4 dB for the hybrid mode unit.

In most applications the significant savings in size, weight, and cost would make the new hybrid mode VPD an attractive alternative to a conventional waveguide VPD. It also is believed that no other microstrip, stripline or coax VPD would perform as well as the hybrid mode VPD.

While only a few exemplary embodiments of ths invention have been described in detail, those skilled in the art will recognize that many variations and modifications may be made in these examples while yet retaining many of the novel features and advantages of this invention. All such variations and modifications are intended to be included within the scope of the appended claims.

What is claimed is:

1. A radio frequency phase shifter comprising:

a latching non-reciprocal RF phase shifter having at least one ferrimagnetic toroid with a conductive latch wire and a dielectric slab disposed along a longitudinal axis between opposite ends of a conductive waveguide;

said phase shifter being disposed serially with a microstrip RF transmission line via an impedance-matched transition located adjacent at least at one of the ends of said waveguide, said transition being effected without extending into a toroid wall.

2. A radio frequency phase shifter as in claim 1, wherein said RF phase shifter comprises:

a pair of axially elongated ferrimagnetic toroids with said dielectric slab affixed therebetween, said conductive waveguide being formed by metallization of the outermost surfaces of the composite toroid-slab-toroid structure; and conductive latch wires being threaded through the open centers of the toroids for use in setting remnant magnetic flux within said toroids to predetermined values.

3. A radio frequency phase shifter comprising:

a latching non-reciprocal RF phase shifter having at least one ferrimagnetic toroid with a conductive latch wire and a dielectric slab disposed along a longitudinal axis between opposite ends of a conductive waveguide;

said phase shifter being disposed serially with a microstrip RF transmission line via an impedance-matched transition located adjacent at least at one of the ends of said waveguide, said transition being effected without extending into a toroid wall, said transition having a conductive probe extending perpendicularly from a terminated end of said microstrip transmission line along and in contact with a respective end of said dielectric slab.

4. A radio frequency phase shifter comprising:

an RF phase shifter having a dielectric slab disposed along a longitudinal axis between opposite ends of a conductive waveguide;

said phase shifter being disposed serially with a microstrip RF transmission line via an impedance-matched transition located at least at one of the ends of said waveguide;

said impedance-matched transition including a conductive probe extending perpendicularly from a terminated end of said microstrip transmission line along and in contact with a respective end of said dielectric slab; and a conductive end cap conductively connected to each end of said waveguide, said end caps enclosing the probe at each end of the waveguide and defining dimensioned capacitive gaps between the probe and end cap for use in achieving matched impedance transitions between waveguide and microstrip RF modes.

5. A radio frequency phase shifter as in claim 4, further comprising:

a U-shaped dielectric spacer located at each end of the waveguide with its legs extending longitudinally into the waveguide and its bight portion being disposed between a respective probe and end cap.

6. A radio frequency phase shifter comprising:

an RF phase shifter having a dielectric slab disposed along a longitudinal axis between opposite ends of a conductive waveguide;

said phase shifter being disposed serially with a microstrip RF transmission line via an impedance-matched transition located at least at one of the ends of said waveguide; and wherein said impedance-matched transition comprises a conductive link capacitively coupled between said microstrip line and said waveguide at a point proximate said dielectric slab.

7. A radio frequency phase shifter as in claim 6, wherein:

said conductive link includes a ribbon member capacitively coupled at one end to said microstrip line and conductively coupled at its other end to said waveguide.

8. A radio frequency phase shifter as in claim 6, wherein:

said waveguide is disposed with its ends between abutting ends of dielectric substrates having first conductive ground plane surfaces and second surfaces with said microstrip transmission line formed thereon;

said first conductive ground plane surfaces of the substrates being conductively coupled with each other and with one side of said abutting waveguide ends;

said substrates being of lesser thickness than said waveguide; and said conductive link defining a predetermined gap G between it and the exposed respective end of said dielectric slab.

9. A radio frequency phase shifter as in claim 8, wherein:

said conductive link includes a ribbon member capacitively coupled at one end to said microstrip line and conductively coupled at its other end to said waveguide.

10. A radio frequency phase shifter as in claim 8, wherein said gap G is of approximately triangular shape.

11. A radio frequency phase shifter as in claim 9, including a discrete chip capacitor affixed to each microstrip transmission line at a predetermined distance away from said dielectric slab.

12. A radio frequency phase shifter as in claim 11, wherein each said capacitor has a capacitance of aproximately 0.3 pf.

13. A hybrid mode RF phase shifter comprising:

a latching non-reciprocal conductive waveguide phase shifter having at least one ferrimagnetic toroid with a conductive latch wire extending longitudinally between two ends;

a first microstrip line;

a first impedance matched coupling between said first microstrip line and one end of said waveguide phase shifter, said first coupling being effected without extending into a toroid wall;

a second microstrip line; and a second impedance matched coupling between said second microstrip line and the other end of said waveguide phase shifter, said second coupling also being effected without extending into a toroid wall.

14. A hybrid mode RF phase shifter comprising:

a dielectric substrate having a conductive ground plane surface on one side;

a latching non-reciprocal waveguide phase shifter having metallized surfaces affixed to said ground plane surface and having at least one ferrimagnetic toroid with a conductive latch wire extending longitudinally between two ends;

apertures extending through said ground plane conductive surface and said substrate beyond and adjacent the ends of said waveguide phase shifter;

conductive microstrip transmission lines disposed on the other side of said substrate respectively terminating at said apertures; and a conductive probe extending through each of said apertures beyond and adjacent the ends of said phase shifter and electrically connected, respectively, to the conductive microstrip transmission lines terminating thereat so as to effect matched impedance RF couplings between the microstrip transmission lines and said phase shifter, said couplings not extending into the walls of said toroid.

15. A hybrid mode RF phase shifter as in claim 14, wherein each probe is mounted at a center line of said waveguide phase shifter.

16. A hybrid mode RF phase shifter comprising:

a dielectric substrate having a conductive ground plane surface on one side;

a waveguide phase shifter having metallized surfaces affixed to said ground plane surface;

apertures extending through said ground plane conductive surface and said substrate adjacent the ends of said waveguide phase shifter;

conductive microstrip transmission lines disposed on the other side of said substrate respectively terminating at said apertures;

a conductive probe extending through each of said apertures and electrically connected, respectively, to the conductive microstrip transmission lines terminating thereat; and metal end caps respectively affixed to said conductive ground plane surface and to the metallized surfaces of said waveguide to conductively enclose said conductive probes and assist in establishing matched impedance coupling capacitances between said probes and the waveguide phase shifter.

17. A hybrid mode RF phase shifter as in claim 16, further comprising:

U-shaped dielectric wire guides respectively mounted between said end caps and said probes.

18. A hybrid mode RF phase shifter as in claim 16, wherein said probes are disposed perpendicular to said substrate and extend to a predetermined distance from said end caps to establish a gap G determinative, at least in part, o said coupling capacitances.

19. A hybrid mode RF phase shifter comprising:

a substrate of dielectric material;

a metallized surface on one side of said substrate;

a pair of axially-elongated, parallel, ferrimagnetic toroids mounted on said metallized surface;

a slab of dielectric material mounted between said toroids;

a metal covering on the exposed surfaces of said toroids and slab, said metal covering being in electrical contact with said metallized surface;

apertures in said metallized surface and in said substrate respectively adjacent opposite ends of said slab;

separate metal microstrip transmission lines formed on one side of said substrate opposite said metallized surface, said lines respectively terminating at said apertures;

conductive probes respectively mounted in electrical contact with the terminations of said lines and extending through said apertures adjacent the ends of said slab; and electrical current conductors respectively extending axially through said toroids.

20. A hybrid mode RF phase shifter comprising:

a rectangular waveguide phase shifter having metal outer surfaces;

a pair of planar dielectric substrates, one surface of each of which is conducting and the other surface having narrow conductive strips, the height of each of said substrates being less than the height of said waveguide phase shifter;

said substrates being disposed in abutting relationship with opposite ends of said waveguide phase shifter with their conducting surfaces electrically connected to the metal outer surface of said rectangular waveguide phase shifter at one side of the phase shifter;

capacitance elements respectively mounted on the narrow conductive strips of said substrate at locations spaced from respective ends of the waveguide phase shifter; and conductive ribbons respectively suspended between said capacitance elements and the metal outer surface of said waveguide phase shifter that is displaced therefrom.

21. A hybrid mode RF phase shifter comprising:

a rectangular waveguide phase shifter having metal outer surfaces;

a pair of planar dielectric substrates, one surface of each of which is conducting and the other surface having narrow conductive strips, the height of each of said substrates being less than the height of said waveguide phase shifter;

said substrates being disposed in abutting relationship with opposite ends of said waveguide phase shifter with their conducting surfaces electrically connected to the metal outer surface of said rectangular waveguide phase shifter at one side of the phase shifter;

capacitance elements respectively mounted on the narrow conductive strips of said substrate at locations spaced from respective ends of the waveguide phase shifter; and conductive ribbons respectively suspended between said capacitance elements and the metal outer surface of said waveguide phase shifter that is displaced therefrom;

said waveguide phase shifter including two ferrimagnetic toroids mounted within said metal outer surfaces, a slab of dielectric material being mounted between said toroids, and said conductive ribbons being in contact with said metal outer surfaces at a point adjacent said slab.

22. A hybrid mode RF phase shifter comprising:

two parallel ferrimagnetic toroids having rectangular cross sections:

a slab of dielectic material in contact with adjacent sides of said toroids a conductive surface on the outer sides of said toroids and slab;

two microstrip transmission lines, each including a planar dielectric substrate, one surface of which is conducting and the other surface having a narrow conductive strip thereon, the thickness of said substrate being less than the thickness of said toroids;

said microstrip transmission lines being in abutting relationship with opposite ends of said toroids, with the conducting surfaces of a first side of the toroids being in electrical contact with the conductive surface of said slab;

capacitance elements respectively mounted on said narrow conductive strip of said microstrip transmission lines spaced from the ends of said toroids; and conductive ribbon suspended between said capacitance elements and a conductive surface adjacent said slab.

23. A hybrid mode RF phase shifter as in claim 22 wherein the conductive ribbon is conductively attached to the narrow conductive strip of said microstrip and capacitively coupled to a conductive surface of waveguide adjacent the high dielectric slab.

24. A variable RF power divider comprising:

a dielectric substrate;

a first microstrip fixed power divider/combiner mounted on said substrate, said first divider/combiner having an input/output microstrip lead and two output/input microstrip leads;

a second microstrip fixed power divider/combiner mounted on said substrate and having two input/output microstrip leads and two output/input microstrip leads;

first and second hybrid mode RF phase shifters, each as in claim 1, 13 or 14, said first hybrid mode phase shifter being connected between one output/input lead of said first divider/combiner and one output/input lead of said second divider/combiner; and the second said hybrid mode RF phase shifter being connected between the other output/input lead of said first divider/combiner and the other input/output lead of said second divider/combiner.

25. A radio frequency phase shifter comprising:

an RF phase shifter having a dielectric slab disposed along a longitudinal axis between opposite ends of a conductive waveguide;

said phase shifter being disposed serially with a microstrip RF transmission line via an impedance-matched transition located at least at one of the ends of said waveguide;

said RF phase shifter including a pair of axially elongated ferrimagnetic toroids with said dielectric slab affixed therebetween, said conductive waveguide being formed by metallization of the outermost surfaces of the composite toroid-slab-toroid structure; and conductive latch wires being threaded through the open centers of the toroids for use in setting remnant magnetic flux within said toroids to predetermined values;

said impedance-matched transition including a conductive probe extending perpendicularly from a terminated end of said microstrip transmission line along and in contact with a respective end of said dielectric slab; and a conductive end cap conductively connected to each end of said waveguide, said end caps enclosing the probe at each end of the waveguide and defining dimensioned capacitive gaps between the probe and end cap for use in achieving matched impedance transitions between waveguide and microstrip RF modes.

26. A radio frequency phase shifter as in claim 25, further comprising:

a u-shaped dielectric spacer located at each end of the waveguide with its legs extending longitudinally into the waveguide and its bight portion being disposed between a respective probe and end cap.

27. A radio frequency phase shifter comprising:

an RF phase shifter having a dielectric slab disposed along a longitudinal axis between opposite ends of a conductive waveguide;

said phase shifter being disposed serially with a microstrip RF transmission line via an impedance-matched transition located at least at one of the ends of said waveguide; and said RF phase shifter including a pair of axially elongated ferrimagnetic toroids with said dielectric slab affixed therebetween, said conductive waveguide being formed by metallization of the outermost surfaces of the composite toroid-slab-toroid structure; and conductive latch wires being threaded through the open centers of the toroids for use in setting remnant magnetic flux within said toroids to predetermined values;

said impedance-matched transition comprising a conductive link capacitively coupled between said microstrip line and said waveguide at a point proximate said dielectric slab.

28. A radio frequency phase shifter as in claim 27, wherein:

said conductive link includes a ribbon member capacitively coupled at one end to said microstrip line and conductively coupled at its other end to said waveguide.

29. A radio frequency phase shifter as in claim 27, wherein said waveguide is disposed with its ends between abutting ends of dielectric substrates having first conductive ground plane surfaces and second surfaces with said microstrip transmission line formed thereon;

said first conductive ground plane surfaces of the substrates being conductively coupled with each other end with one side of said abutting waveguide ends;

said substrates being of lesser thickness than said waveguide; and said conductive link defining a predetermined gap G between it and the exposed respective end of said dielectric slab.

30. A radio frequency phase shifter as in claim 29, wherein:

said conductive link includes a ribbon member capacitively coupled at one end to said microstrip line and conductively coupled at its other end to said waveguide.

31. A radio frequency phase shifter as in claim 29, wherein said gap G is of approximately triangular shape.

32. A radio frequency phase shifter as in claim 30, including a discrete chip capacitor affixed to each microstrip transmission line at a predetermined distance away from said dielectric slab.

33. A radio frequency phase shifter as in claim 32, wherein each said capacitor has a capacitance of approximately 0.3 pf.

34. A variable RF power divider comprising:

a dielectric substrate;

a first microstrip fixed power divider/combiner mounted on said substrate, said first divider/combiner having an input/output microstrip lead and two output/input microstrip leads;

a second microstrip fixed power divider/combiner mounted on said substrate and having two input/output microstrip leads and two output/input microstrip leads;

first and second hybrid mode RF phase shifters, each said phase shifter including a substrate of dielectric material;

a metallized surface on one side of said substrate;

a pair of axially-elongated, parallel, ferrimagnetic toroids mounted on said metallized surface;

a slab of dielectric material mounted between said toroids;

a metal covering on the exposed surfaces of said toroids and slab, said metal covering being in electrical contact with said metallized surface;

apertures in said metallized surface and in said substrate respectively adjacent opposite ends of said slab;

separate metal microstrip transmission lines formed on one side of said substrate opposite said metallized surface, said lines respectively terminating at said apertures;

conductive probes respectively mounted in electrical contact with the terminations of said lines and extending through said apertures adjacent the ends of said slab; and electrical current conductors respectively extending axially through said toroids;

said first hybrid mode phase shifter being connected between one output/input lead of said first divider/combiner and one output/input lead of said second divider/combiner; and the second said hybrid mode RF phase shifter being connected between the other output/input lead of said first divider/combiner and the other input/output lead of said second divider/combiner.

35. A variable RF power divider comprising:

a dielectric substrate;

a first microstrip fixed power divider/combiner mounted on said substrate, said first divider/combiner having an input/output microstrip lead and two output/input microstrip leads;

a second microstrip fixed power divider/combiner mounted on said substrate and having two input/output microstrip leads and two output/input microstrip leads;

first and second hybrid mode RF phase shifters, each said phase shifter including a rectangular waveguide phase shifter having metal outer surfaces;

a pair of planar dielectric substrates, one surface of each of which is conducting and the other surface having narrow conductive strips, the height of each of said substrates being less than the height of said waveguide phase shifter;

said substrates being disposed in abutting relationship with opposite ends of said waveguide phase shifter with their conducting surfaces electrically connected to the metal outer surface of said rectangular waveguide phase shifter at one side of the phase shifter;

capacitance elements respectively mounted on the narrow conductive strips of said substrate at locations spaced from respective ends of the waveguide phase shifter; and conductive ribbons respectively suspended between said capacitance elements and the metal outer surface of said waveguide phase shifter that is displaced therefrom;

said first hybrid mode phase shifter being connected between one output/input lead of said first divider/combiner and one output/input lead of said second divider/combiner; and the second said hybrid mode RF phase shifter being connected between the other output/input lead of said first divider/combiner and the other input/output lead of said second divider/combiner.

36. A variable RF power divider as in claim 35 wherein:

said waveguide phase shifter includes two ferrimagnetic toroids mounted within said metal outer surfaces, a slab of dielectric material being mounted between said toroids, and said conductive ribbons being in contact with said metal outer surfaces at a point adjacent said slab.

37. A variable RF power divider comprising:

a dielectric substrate;

a first microstrip fixed power divider/combiner mounted on said substrate, said first divider/combiner having an input/output microstrip lead and two output/input microstrip leads;

a second microstrip fixed power divider/combiner mounted on said substrate and having two input/output microstrip leads and two output/input microstrip leads;

first and second hybrid mode RF phase shifters, each said phase shifter including two parallel ferrimagnetic toroids having rectangular cross sections;

a slab of dielectric material in contact with adjacent sides of said toroids;

a conductive surface on the outer sides of said toroids and slab;

two microstrip transmission lines, each including a planar dielectric substrate, one surface of which is conducting and the other surface having a narrow conductive strip thereon, the thickness of said substrate being less than the thickness of said toroids;

said microstrip transmission lines being in abutting relationship with opposite ends of said toroids, with the conducting surfaces of a first side of the toroids being in electrical contact with the conductive surface of said slab;

capacitance elements respectively mounted on said narrow conductive strip of said microstrip transmission lines spaced from the ends of said toroids; and conductive ribbon suspended between said capacitance elements and a conductive surface adjacent said slab;

said first hybrid mode phase shifter being connected between one output/input lead of said first divider/combiner and one output/input lead of said second divider/combiner; and the second said hybrid mode RF phase shifter being connected between the other output/input lead of said first divider/combiner and the other input/output lead of said second divider/combiner.

* * * * *